United States Patent [19]

Roth

[11] Patent Number: 4,625,740

[45] Date of Patent: Dec. 2, 1986

[54] FINGERNAIL TIP DEVICE

[75] Inventor: Nancy L. Roth, Carmichael, Calif.

[73] Assignee: Top of the Line Nail Tips, Inc., Carmichael, Calif.

[21] Appl. No.: 491,375

[22] Filed: May 4, 1983

[51] Int. Cl.[4] ..... A45D 29/00

[52] U.S. Cl. ..... 132/73

[58] Field of Search ..... 132/73, 88.5, 88.7

[56] References Cited

U.S. PATENT DOCUMENTS 4,408,622 10/1983 Meyerhoefer ..... 132/73

*Primary Examiner*—Gregory E. McNeill

*Attorney, Agent, or Firm*—Leonard Bloom

[57] ABSTRACT

An artificial nail tip to be applied to a natural nail comprising a thin flexible upwardly convex plastic sheet with a stepped shoulder portion for abutting engagement with the forward leading edge of a natural nail, a central portion of enhanced thickness for structural integrity, a rear portion overlying and conforming to the top surface of the natural nail for adhesive engagement thereto, and two cusp portions extending along the periphery of the natural and artificial nail for adhesive engagement thereto to provide lateral structural integrity.

13 Claims, 4 Drawing Figures

FINGERNAIL TIP DEVICE

BACKGROUND OF THE INVENTION

The instant invention relates generally to cosmetic devices, and more specifically to an artificial fingernail tip device.

It has long been the practice by women of many cultures to allow extended growth of their fingernails which are manicured, shaped, and colored to enhance the beauty of the female hand. In the past this has required careful and controlled growth of the natural nail to achieve the desired appearance. If a natural nail broke, it would take months to regrow same to the desired length. In more recent times, artificial nail tip extensions have been developed which are secured to the natural nail by means of adhesive so that a damaged nail can be immediately replaced, thereby avoiding the problems associated with the time required to regrow a natural nail. In fact, it is presently a common practice to fix a complete set of artificial fingernails to shortened natural fingernails instead of attempting to grow the natural to an extended length. This practice provides a uniformity of nail length and shape, while also providing a consistent surface upon which to apply nail polish. Artificial nails have been well accepted as a means to enhance the beauty of a woman's hand, however there are a number of problems and disadvantages associated with prior art devices.

Applicant's extensive experience as a manicurist has provided her with a great deal of knowledge concerning the problems associated with currently available artificial fingernail tips. Chief among these problems is the tendency for prior art devices to bend, break, or otherwise be dislodged during normal use, which may in fact result in injury or damage to the natural fingernail associated with the artificial fingernail. Prior art devices may often bend backwards creasing across the width, which destroys the artificial nail. Another common dislodgement occurs when lateral pressure is applied to the nail causing edge portions of the nail to uplift, sometimes tearing a portion of the natural nail causing pain and injury. A further structural problem associated with prior art devices is that they have a tendency to crack along the peripheral edge proximate to the adhesion point to the natural nail where the aritifical nail is usually thinner. The above mentioned problems and disadvantages reduce the normal life of an aritifical nail tip to two or three days under typical wear and tear. The device according to the instant application is designed to last for two or three weeks under normal conditions.

Therefore there is a strong felt yet unfulfilled need for a device according to the instant application which has a strengthened central portion to prevent damage to the artifical nail upon nail tip impact, and is further provided with extended cusp portions along a peripheral edge associated with the natural fingernail to ensure lateral strength and prevent cracking at the critical structural juncture where the artificial nail and the natural are adhered together. Furthermore, the instant device is provided with an extended central overlap portion which increases the surface area of adhesion in a central zone to ensure structural integrity because of an enlarged bonding surface.

Applicant is aware of the following two citations which would appear to be germane to the patent process:

Matranga et. al. U.S. Pat. No. 4,007,748

Matranga et. al. U.S. Pat. No. 4,135,526

The artificial fingernail devices according to the above citations exhibit many of the disadvantages and problems characterized hereinabove in that they are susceptible to breaking, cracking, and dislodgement due to their inherent structural inferiority. The device according to the instant application represents a vast improvement in the structural integrity and therefore the durability of the artificial fingernail tip.

SUMMARY AND OBJECTS OF THE INVENTION

Accordingly, it is a primary object of the present invention to provide a novel artificial nail tip in which a central ridge portion extending longitudinally is structurally reinforced to prevent the artificial nail from damage due to impact of the nail tip from a direct blow or jab to the forward leading edge thereof.

It is another object of the present invention to provide a novel artificial nail tip in which the lateral peripheral edge portions adjacent to and adherred to the natural nail are extended and structurally reinforced so that lateral pressure applied to the artificial nail will not dislodge same from the natural nail, and further prevents the artificial from cracking along the lateral peripheral edge where it is most susceptible to start a crack.

It is a further object of the present invention to provide a novel artificial fingernail with a cresent-shaped step on the underside thereof for abutting engagement with the forward leading edge of a natural fingernail to ensure the proper alignment and engagement of the artificial nail with natural nail.

It is yet another object of the present invention to provide a novel artificial fingernail device in which an overlap portion of reduced thickness provides a bottom surface to receive adhesive for secure bonding to the upper surface of the natural nail.

It is yet another object of the present invention to provide a novel artificial fingernail device in which an overlapping portion is relatively thin and pliable enough to conform to the convex upper surface of the natural nail for snug and conformational adherence thereto.

It is a still further object of the present invention to provide a novel artificial fingernail device which can be applied quickly and simply with a quick-drying liquid adhesive to the forward portion of a natural fingernail without any damage to same.

It is yet another object of the present invention to provide an artificial nail tip which exhibits superior structural integrity which greatly increases the life expectancy of the device.

It is yet still another object of the present invention to provide a novel artificial fingernail device which is easy to manufacture and lends itself well to mass production techniques.

These and other objects are accomplished by the provision of an artificial fingernail tip adapted to overlie a forward portion of a natural fingernail and be adhesively bonded thereto, the artificial nail having an overlapping portion to provide a bonding surface and an underlying step portion for abutting engagement with the forward leading edge of a natural nail. The instant device being provided with a thickened longitudinal centrally disposed ridge portion and two peripheral, extended cusp portions to enhance the structural integrity of the device, thereby preventing the breaking, cracking, and dislodgement of the device and other disadvantages associated with prior art devices.

These and other objects and advantages of the instant invention will be more fully understood when viewed in light of the following description taken inconjunction with the appended drawings.

DESCRIPTION OF THE PREFERRED EMBODIMENT

Figure 1:
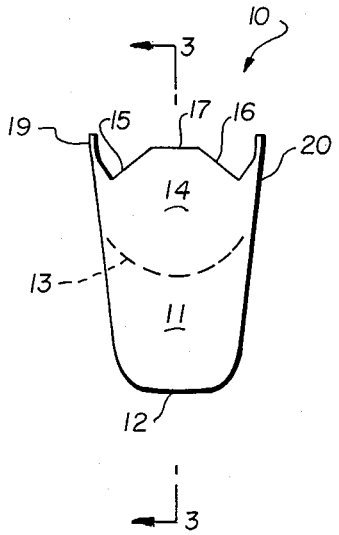
FIG. 1 is a top view of the artificial nail tip.
Figure 2:
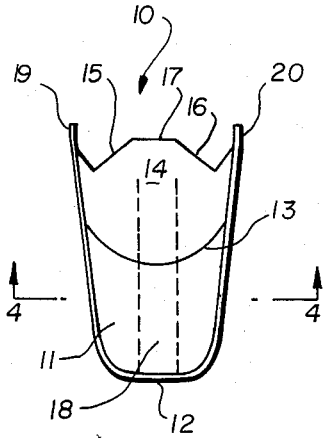
FIG. 2 is a bottom view of that which is shown in FIG. 1.
Figure 3:
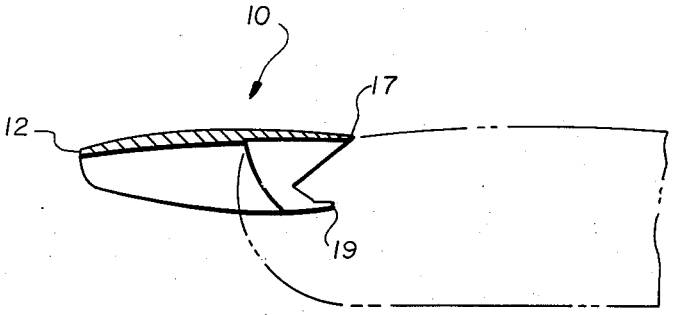
FIG. 3 is a side sectional view of that which is shown in FIG. 1, taken along lines 3—3, with a finger shown in phantom.

Referring now to the drawings in detail wherein like reference numerals refer to like parts throughout the several figures, reference numeral 10 refers generally to the device according to the instant application. The device 10 has a longitudinally extended body 11 which transversely tapers as it continues forwardly to a forward leading edge 12. The body has an upwardly convex transverse profile in general conformation with the shape of a normal human fingernail. The body gently slopes downwardly as it tapers forwardly so that the forward leading edge 12 is slightly downwardly extended, as best shown in FIG. 3.

A rear medial portion of the underside of the body 11 is provided with a rearwardly concave vertical step portion 13 forming a shoulder to abutt against the forward edge of a natural fingernail, thereby aligning the device 10 in the proper position for easy and efficient installation of the device when being adherred to a natural fingernail. The medial rear portion of the body 14 is of relative diminished thickness rearwardly from the vertical shoulder 13. This portion 14 directly overlies the natural finger nail and provides on a bottom surface thereof an extended surface for the application of adhesive. The diminished thickness of the extended rear portion 14 allows same the flexibility to be manually pressed into conformational engagement with the upper surface of a natural nail. The medial rear portion 14 of the body 11 is defined by two peripheral edges 15 and 16 extending diagonally and inwardly to a rear edge portion 17, thereby increasing the rearward extension medial rear portion 14 the underside of which is glued to the natural nail. This configuration of the medial rear portion 14 increases the surface area of the body 11 which is actually adherred to the natural nail, which increases the structural integrity of the bond therebetween so that the artificial nail according to the instant application can endure greater loads and stresses applied to the forward leading edge 12 without bending or breaking or becoming dislodged from the natural nail.

Figure 4:
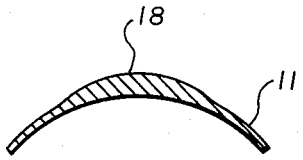
FIG. 4 is a cross sectional view of that which is shown in FIG. 2 taken along lines 4—4.

To further add to the abovementioned structural integrity, the body 11 has extending longitudinally throughout a central ridge portion 18 of increased thickness which extends from the forward leading edge 12 rearwardly past the shoulder portion 13 and gradually diminishing in thickness as the ridge approaches the rear edge 17 of the medial rear portion 14. Similarly, the ridge of enhanced thickness 18 gradually reduces thickness transversely, returning to the normal thickness of the body 11. The ridge 18 forms the structural back bone around which the body 11 flexes transversely. As the central ridge 18 approaches the forward leading edge 12 its thickness is reduced so that the leading edge 12 is of uniform transverse thickness as is shown in FIGS. 3 and 4. The central ridge 18 ensures the longitudinal structural integrity of the nail 10 thereby preventing it from being bent downwardly or upwardly and breaking therefrom.

In order to prevent breakage of the nail 10 from laterally applied forces, two extended and thickened cusp portions 19 and 20 extend rearwardly along the peripheral edge of the natural nail and are adapted to be adhesively engaged thereto. The cusps 19 and 20 are of greater thickness than the body 11, the thickened portion extending forwardly along the peripheral edge of the nail to a point somewhat forward of the shoulder 13, thereafter the thickened periphery gradually reduces to the thickness of the body 11. The cusps diminish in thickness at their rearward extremities to allow for easy manipulation and adherence. The cusps, along with the extended thickened peripheral edge, prevent lateral pressures from cracking the artificial nail at the critical juncture where the artificial nail joins the natural nail, which is the site of most of the cracks that develop in artificial nail-type devices. Thus each cusp 19 and 20 is securely engaged to the natural nail by means of adhesive, thereby preventing lateral pressures on the artificial nail from dislodging same from the natural nail.

It should be noted that the artificial nail 10 may be formed in a variety of sizes from a plastic or acrylic substance or the like which provides the flexibility and strength to conform to the configuration of the natural nail, yet also provides the structural integrity to endure the rigors of normal wear and tear. Furthermore, the forward leading edge 12 may be shaped by cutting or filing same to the desired configuration, thereby providing the wearer with the ability adjust the forward configuration of the nail according to taste.

In use and operation one applies a liquid adhesive to the bottom side of the rear portion 14 and the inward surface of the cusps 19 and 20, thereafter placing the nail in abutting contact with the natural nail so that the forward edge of the natural nail engages the vertical shoulder 13, which ensures alignment of the artificial nail 10 with the natural nail. A slight manual pressure causes the artificial nail to flex and conform to the upper convex surface of the natural nail. The cusp portions 19 and 20 are pressed into adhesive contact with the periphery of the natural nail, thereby anchoring the body 11 and preventing dislodgement by any lateral forces applied to the artificial nail. After the quick-drying liquid adhesive has secured the nail, any commercially available acrylic powder compound can be applied to blend or feather the surfaces of the artificial nail to gradually taper to the upper surface of the natural nail, thereby giving the appearance of one contiguous surface. Thereafter a nail polish may be applied to the upper surface of the artificial and natural nail which gives the final appearance of a polished and contiguous surface essentially indistinguishable from a natural nail of extended length.

It should be noted that numerous structural changes and modifications may be resorted to without departing from the spirit of the invention.

I claim:

1. An artificial fingernail tip to be worn in conjunction with a natural fingernail having a top surface, comprising in combination:

(a) a thin, elongated, upwardly convex body having a forward leading edge and further having a longitudinal central ridge portion of enhanced thickness for added strength, the longitudinal central ridge portion having a non-uniform cross-section and tapering towards the forward leading edge, (b) a crescent-shaped vertical step portion along a rear underside surface of said body for abutting engagement with the forward lading edge of a natural fingernail, such that the body is supported only on the top surface of the natural fingernail, (c) two extended cusp portions along rear peripheral edges of both sides of said body and extending rearwardly of the step portion for added lateral strength, and (d) a reduced thickness rearward medial portion of said body proximate said step and extending rearwardly therefrom to overlay a natural nail tip.

whereby said artificial nail can be adhesively affixed to a natural nail by applying adhesive means to a bottom surface of said rear medial portion and an inner surface of said cusp portions, abutting said step portion against the forward leading edge of a natural fingernail and manipulating said artificial fingernail tip into conformation engagement with a natural fingernail.

2. Device of claim 1 wherein said body further comprises a flexible plastic sheet, upwardly convex with a forward leading edge crescent shaped and tapered to uniform thickness to give the appearance of a natural nail.

3. Device of claim 2 wherein said central ridge of said body extends on an upper surface of said body longitudinally from said forward leading edge, generally becoming thicker through a central portion thereof, to a terminal point rearward of said step proximate to a rear edge of said rear medial portion, at which point said ridge gradually reduces thickness becoming substantially the same thickness as said rear medial poriton, whereby said ridge is gradually tapered in thickness longitudinally so that said ridge blends in with and is visually indistinguishable from an upper surface of said body.

4. Device of claim 3 wherein said central ridge tapers in thickness transversely throughout the longitudinal length gradually becoming substantially the same thickness as adjacent portions of said body, whereby said ridge is gradually tapered in thickness transversely to that said ridge blends in with and is visually indistinguishable from an upper surface of said body.

5. Device of claim 4 wherein said central ridge forms a structural backbone for said fingernail tip allowing said body to flex transversely about said ridge while greatly reducing the longitudinal flex of said body, whereby said body can flex transversely for conformational engagement with a natural nail, but said fingernail tip is rigid longitudinally providing enhanced structural integrity once affixed to a natural nail.

6. Device of claim 5 wherein said vertical step extends on a bottom surface of said body in a crescent shape between said peripheral edges on opposed sides of said body, whereby a leading edge of a fingernail can be easily shaped so that same comes in abutting engagement with said step along its extent when said fingernail tip is applied, thereby properly aligning and supporting said fingernail tip during and after the installation process.

7. Device of claim 6 wherein said cusp portions form rearward extensions of enhanced thickness of said peripheral edges gradually reducing thickness at a rear terminal portion to allow easy manipulation thereof, whereby said periheral edges and said cusps are structurally reinforced by enhanced thickness along the peripheral extent where said fingernail tip is adhesively joined with a natural nail so that said fingernail tip can endure lateral stress without cracking or bending at the critical juncture area.

8. Device of claim 7 wherein said rear medial portion of said body defines a zone of reduced thickness relative to the forward portions of said body, said zone defining said rear medial portion extending rearwardly from said step and terminating at a back edge distanced from said step to a greater extent at a central portion of said zone proximate the termination point of said ridge, whereby the bottom surface area of said zone to be bonded to a natural nail is the greatest directly beneath a longitudinal axis defined by said ridge thereby providing enhanced anchoring of said fingernail tip to a natural nail.

9. Device of claim 8 wherein said zone defining said rear medial portion is of reduced thickness, whereby said zone flexes to allow conformational and contigious contact of same with the upper forward portion of a natural nail which said zone overlies.

10. Device of claim 9 wherein said fingernail tip receives on an upper surface thereof a filler of acrylic compound to blend said fingernail tip with said natural nail to form a smooth contigious surface upon which to apply nail polish and ornamentation.

11. An artificial fingernail tip to be worn in conjunction with a natural fingernail having a top surface and a lower surface and further having a forward edge, comprising a body including a forward portion and further including a rear portion, the forward and rearward portions being separated by a vertical step portion, the vertical step portion being substantially crescent shaped and forming a shoulder for substantial abutting engagement with the forward edge of the natural fingernail, such that the rear portion of the body is supported only on the top surface of the natural fingernail, the forward portion of the body having a forward leading edge, the body further having a longitudinal central ridge portion extending throughout the forward portion and at least a portion of the rear portion of the body, the longitudinal central ridge portion tapering to a diminished thickness towards the forward leading edge of the forward portion of the body, and the forward leading edge having a substantially uniform thickness.

12. An artificial fingernail tip to be worn in conjunction with a natural fingernail having a top surface and further having a forward edge, comprising a body including a forward portion and further including a rear portion, the forward and rearward portions being separated by a vertical step portion, the vertical step portion forming a shoulder for substantial abutting engagement with the forward edge of the natural fingernail, whereby the rear portion of the body is supported only on the top surface of the natural fingernail, the rear portion of the body including a centrally disposed rear edge portion and further including lateral end portions, each of which has a rearwardly extending thickened cusp portion, and each of the cusp portions being separated from the rear edge portion by a diagonally notched portion, whereby the artificial fingernail tip can accommodate greater loads with increased flexibility.

13. An artificial fingernail tip to be worn in conjunction with a natural fingernail, the natural fingernail having a top surface and a lower surface and further having a forward edge, comprising a body including a forward portion and further including a rear portion, the rear portion of the body being supported on the top surface of the natural fingernail only, the forward portion of the body having a forward leading edge, the body further having a longitudinal central ridge portion extending throughout at least the forward portion of the body, the longitudinal central ridge portion tapering to a diminished thickness towards the forward leading edge of the forward portion of the body, the rear portion of the body including a centrally disposed rear edge portion and further including lateral end portions, each of which is provided with a rearwardly-extending cusp portion, and each of the cusp portions being separated from the rear edge portion by a substantially diagonally notched portion, whereby the artificial fingernail tip has increased flexibility and can accommodate greater impacts and other loads.

* * * * *